US009964885B2

(12) United States Patent
Sumioka

(10) Patent No.: US 9,964,885 B2
(45) Date of Patent: May 8, 2018

(54) ELECTROSTATIC CHARGE IMAGE DEVELOPING TONER

(71) Applicant: KYOCERA Document Solutions Inc., Osaka (JP)

(72) Inventor: Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/120,715

(22) PCT Filed: Feb. 10, 2015

(86) PCT No.: PCT/JP2015/053621
§ 371 (c)(1),
(2) Date: Aug. 22, 2016

(87) PCT Pub. No.: WO2015/129448
PCT Pub. Date: Sep. 3, 2015

(65) Prior Publication Data

US 2017/0010552 A1 Jan. 12, 2017

(30) Foreign Application Priority Data

Feb. 25, 2014 (JP) ..... 2014-034247

(51) Int. Cl.
*G03G 9/087* (2006.01)
*G03G 9/093* (2006.01)
*G03G 9/08* (2006.01)
*G03G 9/09* (2006.01)

(52) U.S. Cl.
CPC ..... *G03G 9/09328* (2013.01); *G03G 9/0819* (2013.01); *G03G 9/0821* (2013.01); *G03G 9/0825* (2013.01); *G03G 9/08795* (2013.01); *G03G 9/08797* (2013.01); *G03G 9/0918* (2013.01); *G03G 9/09357* (2013.01); *G03G 9/09371* (2013.01); *G03G 9/09392* (2013.01)

(58) Field of Classification Search
CPC ..... G03G 9/08751; G03G 9/08764; G03G 9/08766; G03G 9/09307; G03G 9/09328
See application file for complete search history.

(56) References Cited

U.S. PATENT DOCUMENTS

| | | | | |
|---|---|---|---|---|
| 6,436,598 | B1 * | 8/2002 | Honma | G03G 9/09314 430/108.8 |
| 2002/0160289 | A1 * | 10/2002 | Teshima | G03G 9/08 430/108.1 |
| 2005/0271964 | A1 | 12/2005 | Etou et al. | |
| 2009/0123861 | A1 * | 5/2009 | Kouyama | G03G 9/0918 430/108.15 |
| 2014/0363761 | A1 * | 12/2014 | Liu | G03G 15/08 430/105 |

FOREIGN PATENT DOCUMENTS

| | | | | |
|---|---|---|---|---|
| JP | H09-258480 | A | 10/1997 | |
| JP | 2004-294467 | A | 10/2004 | |
| JP | 2004-294469 | A | 10/2004 | |
| JP | 2007-322500 | A | 12/2007 | |
| JP | 2008-261948 | A | 10/2008 | |
| JP | 2009-237110 | * | 10/2009 | G03G 9/08 |
| JP | 2010-113112 | A | 5/2010 | |
| JP | 2013-057873 | A | 3/2013 | |

OTHER PUBLICATIONS

Translation of JP 2009-237110 published Oct. 2009.*

* cited by examiner

*Primary Examiner* — Peter L Vajda
(74) *Attorney, Agent, or Firm* — Studebaker & Brackett PC

(57) ABSTRACT

An electrostatic charge image developing toner includes a plurality of toner particles. Each of the plurality of toner particles includes a toner core and a shell layer covering the toner core. The shell layer contains a thermosetting resin. A content ratio of a toner component insoluble in tetrahydrofuran is at least 90 mass % relative to mass of the toner. Melt viscosity of the toner at 75° C. is at least $1.0\times10^4$ Pa·s and no greater than $1.0\times10^5$ Pa·s. The thermosetting resin is preferably a melamine resin or a urea resin. The toner core preferably contains a binder resin, and the binder resin has a softening point (Tm) of at least 85° C. and no greater than 95° C.

5 Claims, No Drawings

ELECTROSTATIC CHARGE IMAGE DEVELOPING TONER

TECHNICAL FIELD

The present invention relates to an electrostatic charge image developing toner.

BACKGROUND ART

In a technology region where an image is formed according to an electrographic method, an electrostatic charge image developing toner has been fixed on a recording medium such as paper through heating and pressurization using a fixing roller. To achieve energy saving upon fixation and apparatus downsizing, there have been demands for an electrostatic charge image developing toner that can be fixed at lower temperature and that has excellent low-temperature fixability. In the electrostatic charge image developing toner with the excellent low-temperature fixability, a binder resin with a low softening point (Tm) and a low glass transition point (Tg) and a releasing agent with a low softening point have been used. Thus, in a situation in which the electrostatic charge image developing toner is stored under high temperature, there arises a problem that toner particles included in the electrostatic charge image developing toner are likely to aggregate. Then a charge amount of the aggregating toner is more likely to decrease than that of a non-aggregating toner, and thus the aggregating toner is unnecessarily likely to be developed. This may consequently cause an image default.

The electrostatic charge image developing toner includes a plurality of toner particles. Each of the toner particles is typically obtained through a blending process of blending components such as a releasing agent, a colorant, a charge control agent, and a magnetic powder with a binder resin, a kneading process, a pulverization process, and a classifying process.

A method has been suggested for manufacturing an electrostatic charge image developing toner and including a process of aggregating particles obtained by polymerizing monomers containing a binder resin and a process of forming a shell layer on surfaces of the aggregated particles (for example, Patent Literature 1).

CONVENTIONAL ART LITERATURES

Patent Literatures

[Patent Literature 1]

Japanese Patent Application Laid-Open Publication No. 2004-294467

SUMMARY OF THE INVENTION

Solution to Problem

However, due to its insufficient low-temperature fixability and blocking resistance, the electrostatic charge image developing toner described in Patent Literature 1 has poor image quality.

The present invention has been made in view of the problem described above, and it is an object of the present invention to provide an electrostatic charge image developing toner excellent in both the low-temperature fixability and the toner blocking resistance.

Solution to Problem

An electrostatic charge image developing toner of the present invention includes a plurality of toner particles. Each of the plurality of toner particles includes a toner core and a shell layer covering the toner core. The shell layer contains a thermosetting resin. A content ratio of the toner component insoluble in tetrahydrofuran is at least 90 mass % relative to mass of the toner. Melt viscosity of the toner at 75° C. is at least $1.0\times10^4$ Pa·s and no greater than $1.0\times10^5$ Pa·s.

Effects of the Invention

The present invention can provide an electrostatic charge image developing toner excellent in both low-temperature fixability and toner blocking resistance.

DESCRIPTION OF EMBODIMENTS

Hereinafter, the embodiment of the present invention will be described in detail. The present invention is not limited to the embodiments below, and any modification can be made thereto as appropriate within a range of the object of the invention. Note that portions to be described in an overlapping manner may be omitted from the description, but it does not limit the spirits of the invention.

Hereinafter, composition of an electrostatic charge image developing toner (hereinafter, may simply be described as a toner) according to the present embodiment will be described. The electrostatic charge image developing toner according to the present embodiment includes a plurality of toner particles. Each of the plurality of toner particles includes a toner mother particle and a given external additive. The toner mother particle is composed of a toner core and a shell layer. A surface of the toner core includes a coat of the shell layer.

<Toner Core>

The toner core can contain, for example, a binder resin. The toner core may contain, in addition to the binder resin, any given component (for example, at least one of a releasing agent, a colorant, a charge control agent, and a magnetic power) when necessary. The components contained in the toner core will be described below.

[Binder Resin]

No particular limitations are placed on a type of the binder resin contained in the toner core so long as it is a binder resin usable for a toner. Examples of binder resins that can be used include thermoplastic resins such as styrene-based resins, acrylic-based resins, a styrene-(meth) acrylic resin, polyethylene-based resins, polypropylene-based resins, vinyl chloride-based resins, a polyester resin, a polyamide resin, a urethane resin, polyvinyl alcohol-based resins, vinyl ether-based resins, N-vinyl-based resins, and an astyrene-butadiene resin. Among the types of thermoplastic resins listed above, in terms of its capability to provide favorable colorant dispersibility in the toner, toner chargeability, or toner fixibility on a recording medium, the styrene-(meth) acrylic resin or the polyester resin is preferable. Hereinafter, the styrene-(meth) acrylic resin or the polyester resin will be described.

Note that the term "(meth) acrylic" may be used to form a generic name encompassing both acrylic and methacrylic.

A styrene-(meth) acrylic resin is a copolymer of a styrene-based monomer and a (meth) acrylic monomer. Examples of styrene-based monomers include: styrene, α-methylstyrene, vinyltoluene, α-chlorostyrene, o-chlorostyrene, m-chlorostyrene, p-chlorostyrene, and p-ethylstyrene. Examples of (meth) acrylic monomers include alkyl (meth) acrylate such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

A polyester resin can be obtained by condensation polymerization or co-condensation polymerization of a di-, tri-, or higher-hydric alcohol component and a di-, tri-, or higher-basic carboxylic acid component. Examples of components that can be used for synthesis of a polyester resin include: a di-, tri-, or higher-hydric alcohol component and a di- tri-, or higher-basic carboxylic acid component.

Examples of dihydric alcohol components include diols and bisphenols. Examples of diols include: ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of bisphenols include: bisphenol A, hydrogenated bisphenol A, polyoxyethylenated bisphenol A, and polyoxypropylenated bisphenol A. Examples of tri- or higher-hydric alcohol components include: sorbitol, 1,2,3,6-hexanetetraol, 1,4-sorbitan, pentaerythritol, dipentaerythritol, tripentaerythritol, 1,2,4-butanetriol, 1,2,5 Pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of dibasic carboxylic acid components include: maleic acid, fumaric acid, citraconic acid, itaconic acid, glutaconic acid, phthalic acid, isophthalic acid, terephthalic acid, cyclohexanedicarboxylic acid, succinic acid, alkyl succinic acid, alkenyl succinic acid, adipic acid, sebacic acid, azelaic acid, and malonic acid. Examples of the alkyl succinic acid include: n-butylsuccinic acid, isobutylsuccinic acid, n-octylsuccinic acid, n-dodecylsuccinic acid, and isododecylsuccinic acid. Examples of alkenylsuccinic acid include: n-butenylsuccinic acid, isobutenylsuccinic acid, n-octenylsuccinic acid, n-dodecenylsuccinic acid, and isododecenylsuccinic acid. Examples of tri-, or higher-basic carboxylic acid components carboxylic acid components having three or more hydroxyl groups include: 1,2,4-benzenetricarboxylic acid (for example, trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl) methane, 1,2,7,8-octanetetracarboxylic acid, pyromellitic acid, and EMPOL trimer acid. The di-, tri-, or higher-basic carboxylic acid components may each be deformed into an ester-forming derivative such as an acid halide, an acid anhydride, or a lower alkyl ester. Here, the term "lower alkyl" means an alkyl group having a carbon number of at least 1 and no greater than 6.

A softening point (Tm) of the binder resin is preferably at least 85° C. and no greater than 95° C.

A glass transition point (Tg) of the binder resin is preferably at least 50° C. and no greater than 65° C. and more preferably at least 50° C. and no greater than 60° C.

[Releasing Agent]

The toner core may contain a releasing agent when necessary. The releasing agent is typically used for the purpose of improving low-temperature fixability and offset resistance of the toner. No particular limitations are placed on a type of the releasing agent so long as it can be used as a well-known releasing agent for a toner.

Examples of preferable releasing agents include: aliphatic hydrocarbon-based waxes (for example, low molecular-weight polyethylene, low molecular-weight polypropylene, a polyolefin copolymer, a polyolefin wax, a microcrystalline wax, a paraffin wax, and Fischer-Tropsch wax), oxides of aliphatic hydrocarbon-based waxes (for example, a polyethylene oxide wax, and a block copolymer of a polyethylene oxide wax), plant waxes (for example, a candelilla wax, a carnauba wax, Japan wax, a jojoba wax, and a rice wax), animal waxes (for example, beeswax, lanolin, and spermaceti), mineral waxes (for example, ozokerite, ceresin, and petrolatum), waxes containing mainly fatty acid ester (for example, a montanic acid ester wax, and a castor was), and waxes obtained through deoxidation of part or all of fatty acid ester (for example, a deoxidized carnauba wax).

A amount of the releasing agent is preferably at least 1 part by mass and no greater than 30 parts by mass relative to 100 parts by mass of the binder resin and more preferably at least 5 parts by mass and no greater than 20 parts by mass.

[Colorant]

The toner core may contain a colorant when necessary. As a colorant contained in the toner core, a well-known pigment or dye can be used in accordance with a color of the toner particle. Specific examples of a preferable colorant that can be contained in the toner core are presented below.

As a black colorant, carbon black is presented. Moreover, as the black colorant, a colorant can be used which is obtained through toning into black using colorants such as an yellow colorant, a magenta colorant, and a cyan colorant. In configuration in which the toner particle is contained in a color toner, examples of a colorant that can be contained in the toner core include: a yellow colorant, a magenta colorant, and a cyan colorant.

Examples of a yellow colorant that may be used include: condensed azo compounds, isoindolinone compounds, anthraquinone compounds, azo metal complexes, methine compounds, and aryl amido compounds. More specifically, specific examples include: C. I. Pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

Examples of a magenta colorant that can be used include: condensed azo compounds, diketopyrrolopyrroles compounds, anthraquinone compounds, quinacridone compounds, basic dye lake compounds, naphthol compounds, benzimidazolone compounds, thioindigo compounds, and a perylene compounds. More specifically, specific examples include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of a cyan colorant that can be used include copper phthalocyanine compounds, copper phthalocyanine derivatives, anthraquinone compounds, and basic dye lake compounds. More specifically, specific examples include C. I. Pigment Blue (1, 7, 15, 15:1, 15:2, 15:3, 15:4, 60, 62, and 66), Phthalocyanine Blue, C. I. Vat Blue, and C. I Acid blue.

A amount of the colorant is preferably at least 1 part by mass and no greater than 20 parts by mass relative to 100 parts by mass of the binder resin and more preferably at least 3 parts by mass and no greater than 10 parts by mass.

[Charge Control Agent]

Hereinafter, the charge control agent contained in the toner core will be described.

In the present embodiment, the toner core has negative chargeability, and thus the toner core may contain a negatively chargeable charge control agent. Such a charge control agent is used for the purpose of improving charge stability or a charge rise characteristic of the toner and obtaining a toner with excellent durability and stability. The charge rise characteristic of the toner are indexes indicating whether or not the toner can be charged to a predetermined charge level in short time.

[Magnetic Powders]

The toner core may contain a magnetic powder when necessary. Examples of preferable magnetic powders include: ferrite, magnetite, iron, ferromagnetic metals (cobalt, and nickel), alloys (alloys containing both or either of iron and ferromagnetic metal), compounds (compounds containing both or either of iron and a ferromagnetic metal), ferromagnetic alloys (ferromagnetic alloy subjected to ferromagnetization treatment such as heat treatment), and chromium dioxides.

An average particle diameter of the magnetic powder is preferably at least 0.1 μm and no greater than 1.0 μm and more preferably at least 0.1 μm and no greater than 0.5 μm. With the average particle diameter of the magnetic powders in such a range, it is easy to uniformly disperse the magnetic powders in the binder resin.

In a case where the electrostatic charge image developing toner is used as a one-component developer, the amount of the magnetic powders is preferably at least 35 parts by mass and no greater than 60 parts by mass relative to 100 parts by mass of the toner overall and more preferably at least 40 parts by mass and no greater than 60 parts by mass.

<Shell Layer>

In the electrostatic charge image developing toner of the present embodiment, the shell layer covers the surface of the toner core. Hereinafter, components contained in the shell layer will be described.

A resin composing the shell layer includes a thermosetting resin for the purpose of intensity improvement. The resin composing the shell layer preferably has sufficient cationic properties (positive chargeability).

Examples of the thermosetting resin that may be used include a thermosetting resin having the cationic properties (positive chargeability) and a thermosetting resin having a nitrogen atom in a molecular framework thereof. Examples of the thermosetting resin having the cationic properties (positively chargeability) include a thermosetting resin having an amino group (—$NH_2$). Examples of thermosetting resins having an amino group include: a melamine resin, a derivative thereof, a guanamine resin, a derivative thereof (for example, a benzoguanamine resin, an acetoguanamine resin, and a spiroguanamine resin), a sulfonamide resin, a urea resin, a derivative thereof (for example, a glyoxal resin), and an anylin resin. Examples of thermosetting resins having a nitrogen atom in a molecular framework thereof include thermosetting polyimide resin (for example, maleimide-based polymers, bismaleimide-based polymers, amino-bismaleimide-based polymers, and bismaleimide-triazine-based copolymers). One of such types of thermosetting resins may be used alone, or two or more of them may be used in combination.

Among the thermosetting resins, a melamine resin or a urea resin is preferable.

The melamine resin is a polycondensate of melamine and formaldehyde. A monomer used for forming the melamine resin is melamine. The urea resin is a polycondensate of urea and formaldehyde. A monomer used for forming the urea resin is urea. The glyoxal resin as a derivative of the urea resin is a polycondensate of formaldehyde and a reaction product of glyoxal and urea. A monomer used for forming the glyoxal resin is a reaction product of glyoxal and urea.

Mlamine, urea, and urea to be reacted with glyoxal may be subjected to well-known denaturalization. For example, before reacted with a thermoplastic resin, a monomer of the thermosetting resin can be methylolated using formaldehyde to be deformed into a usable derivative. For example, methylolation of melamine using formaldehyde causes deformation thereof into methylol melamine.

The monomer of a thermosetting resin (for example, melamine, urea, or a reaction product of urea and glyoxal) may be used in a form of a prepolymer. The prepolymer of the thermosetting resin is at a stage prior to a polymer in which a polymerization level of the monomer of the thermosetting resin is increased to some extent. A prepolymer of a thermosetting resin is also referred to as a prepolymer or a precondensate.

The shell layer preferably contains a nitrogen atom that originates from melamine resin or urea resin. A material containing a nitrogen atom is likely to be positively charged. Thus, a content of nitrogen atoms in the shell layer is preferably at least 10 mass % relative to the mass of the shell layer.

A film thickness of the shell layer is preferably at least 1 nm and no greater than 20 nm and more preferably at least 1 nm and no greater than 10 nm. With the shell layer having a film thickness of no greater than 20 nm, the shell layer is easily broken by heating and pressurization in toner fixation on the recording medium. As a result, softening and melting of the binder resin contained in the toner core quickly progresses, permitting the toner to be fixed on the recording medium in a low temperature range. Further, a charge amount of the toner particles does not become excessively high, thus permitting appropriate image formation. By contrast, with the shell layer having a film thickness of at least 1 nm, the shell layer has sufficient intensity, thereby suppressing damage on the shell layer as a result of impact thereon in transportation. Here, in a toner particle with an at least partially damaged shell layer, through a portion where the shell layer has been damaged under high temperature, a component of the releasing agent readily exude to a surface of the toner particle. Thus, upon toner saving under high temperature, the toner particles are likely to aggregate. Further, with the shell layer having a film thickness of at least 1 nm, the charge amount of the toner particles does not become excessively low, thus preventing occurrence of any image fault in a formed image.

The film thickness of a shell layer can be measured through analysis of a TEM photographed image of a cross section of a toner particle using a commercially available image analysis software (for example, "WinROOF" produced by Mitani Corporation).

Note that the toner particle may be so configured as to have a plurality of shell layers disposed on the surface of the toner core. In this case, an outermost shell layer over the toner core is preferably cationic.

[Charge Control Agent]

In the present embodiment, the shell layer is preferably cationic (positively chargeable). Thus, the shell layer may contain a positively chargeable charge control agent.

<External Additive>

The toner particle may contain an external additive. In the electrostatic charge image developing toner of the present embodiment, the external additive can be made adhere to a surface of a toner mother particle.

A surface of the shell layer may be subjected to, for example, an external addition using the external additive for the purpose of improving fluidity and handability of the toner particles. To this end, a well-known external addition method is used. More specifically, after an external additive condition is adjusted so as to avoid immersion of the external additive in the shell layer, the toner mother particle is subjected to the external addition using a mixing machine (for example, an FM mixer or Nauta mixer (registered Japanese trademark).

A type of the external additive can appropriately be selected from among external additives for a toner. Examples of the external additive that can be used include silica and metal oxides (aluminum, titanium oxide, magnesium oxide, zinc oxide, strontium titanate, and barium titanate). One type of the external additives may be used alone, or two or more of them may be used in combination.

The external additive can also be hydrophobized using a hydrophobizing agent such as an amino silane coupling agent or silicone oil. The use of the hydrophobized external additive can suppress a decrease in charge amount of the toner under high temperature and high humidity and can also provide favorable toner fluidity.

An additive amount of the external additive is preferably at least 0.1 parts by mass and no greater than 10 parts by mass relative to 100 parts by mass of the toner mother particle and more preferably at least 0.2 parts by mass and no greater than 5 parts by mass. An average particle diameter of the external additive is preferably at least 0.01 μm and no greater than 1.0 μm. With the additive amount and average particle diameter of the external additive in such ranges, the fluidity and handability of the toner particle can be improved.

As an index of a cross linking level of the thermosetting resin contained in the shell layer, there is a content ratio of a toner component insoluble in tetrahydrofuran contained in the toner particle. With a sufficient cross linking level of the thermosetting resin contained in the shell layer, the toner particle is hardly dissolved in tetrahydrofuran. A method of measuring the content ratio of the toner component insoluble in THF will be described.

The electrostatic charge image developing toner (mass: $W_1$) is added to tetrahydrofuran (THF). Slurry obtained through the process is stirred, to cause a component (mass of resin: $W_2$) soluble in the THF to dissolve in the THF. Then the component dissolved in the THF is extracted from the slurry. Using formula below, the content ratio of the toner component insoluble in the THF was calculated.

Content ratio of toner component insoluble in THF (mass %)$=(W_1-W_2)/W_1\times100$ The content ratio of the toner component insoluble in THF is preferably at least 90 mass % relative to the mass of the toner.

Moreover, melt viscosity of the electrostatic charge image developing toner is measured using a capillary rheometer. More specifically, the melt viscosity of the toner is measured in the following manner. The toner is molded in a pellet. The pellet is set in the capillary rheometer, while a load is applied thereto with a plunger, and heated to 200° C. The pellet-shaped toner is pushed out of a nozzle to measure the melt viscosity of the toner at 75° C.

The melt viscosity of the toner at 75° C. is at least $1.0\times10^4$ Pa·s and no greater than $1.0\times10^5$ Pa·s. With the melt viscosity of the toner in such a range, the low-temperature fixability of the toner can be improved.

<<Method for Manufacturing Electrostatic Charge Image Developing Toner>>

The method for manufacturing the electrostatic charge image developing toner can include: for example, a toner core preparation process and a shell layer formation process. In the toner core preparation process, a toner core is prepared. In the shell layer formation process, a shell layer is formed on a surface of the toner core.

The toner core preparation process includes an aggregation process and a coalescing process. In the aggregation process, at least one type of particulates containing at least one type selected from the group consisting of a binder resin, a colorant, and a releasing agent are aggregated in an aqueous medium to form aggregated particles. In the coalescing process, a component contained in the aggregated particles obtained in the aggregation process is subjected to heating treatment to be caused to coalesce.

Note that an external addition process may be included after the shell layer formation process. In the external addition process, an external additive is made adhere to a surface of toner mother particles.

<Toner core Preparation Process>

To execute the toner core preparation process, a method is used which is capable of favorably dispersing a given component (for example, all or part of a releasing agent, a colorant, a charge control agent, and a magnetic powder) when necessary in a binder resin. Examples of the method of executing the toner core preparation process include an aggregation method.

The aggregation method is executed by carrying out the aggregation process and the coalescing process. The toner core preparation according to the aggregation method can provide toner particles having uniform shapes and particle diameter.

In the aggregation process, the particulates containing the component composing the toner core are aggregated in an aqueous medium to form aggregated particles. Then in the coalescing process, the component contained in the aggregated particles obtained by the aggregation process is caused to coalesce in an aqueous medium to obtain toner cores.

[Aggregation Process]

Hereinafter, the aggregation process will be described. In the aggregation process, the aggregated particles are prepared. By forming the binder resin or the composition containing the binder resin into particulates of a desired particle diameter in an aqueous medium, the particulates containing the component composing the toner core are typically prepared as a dispersion liquid of binder resin particulates in which the particulates containing the binder resin (binder resin particulates) are dispersed in an aqueous medium. The dispersion liquid of the binder resin particulates may contain an aqueous dispersion liquid (for example, a dispersion liquid of colorant particulates or a dispersion liquid of releasing agent particulates) of particulates of the given component (for example, the releasing agent or the colorant) other than the binder resin. In the aggregation process, the particulates are aggregated in such a dispersion liquid of the binder resin particulates to obtain the aggregated particles.

Hereinafter, a method of preparing the dispersion liquid of the binder resin particulates (preparation method 1), a method of preparing the dispersion liquid of the releasing agent particulates (preparation method 2), and a method of preparing the dispersion liquid of the colorant particulates (preparation method 3) will be described. To prepare any particulates containing a component other than the components (the binder resin, the colorant, and the releasing agent) used in the preparation methods 1-3, operations in the preparation methods 1 to 3 may appropriately be selected.

The preparation method 1 will be described below. The binder resin is pulverized using a pulverization device (for example, Turbo Mill) to obtain a pulverized product. The obtained pulverized product is dispersed in an aqueous medium such as ion exchanged water, heated, and then given with strong shear force using a high-speed shear emulsification device (for example, "CLEARMIX (registered Japanese trademark)" produced by Mtechnique Co. Ltd.) to thereby obtain a dispersion liquid containing the binder resin particulates. Note that heating temperature is preferably temperature 10° C. higher than the softening point (Tm) of the binder resin (temperature up to approximately 200° C. at a maximum).

An average particle diameter of the binder resin particulates is preferably no greater than 1 μm and more preferably at least 0.05 μm and no greater than 0.50 μm. With the average particle diameter of the binder resin particulates in such a range, particle size distribution of the toner cores is sharp, resulting in uniform toner core shapes. The average particle diameter of the binder resin particulates can be measured using a laser-diffractive particle size distribution analyzer (for example, "SALD-2200" produced by Shimadzu Corporation Ltd.).

The dispersion liquid containing the binder resin particulates may contain a surfactant. Use of the surfactant stabilizes and uniformly disperses the binder resin particulates in an aqueous medium.

In a case where a resin having an acidic group is used as the binder resin, direct micronization of the binder resin in an aqueous medium increases a specific surface area of the binder resin. Thus an increase in the acidic group exposed to a surface of the binder resin particulate may reduce pH of the aqueous medium from approximately 3 to 4. The reduction in the pH of the aqueous medium from approximately 3 to 4 may cause hydrolysis of the binder resin or failure to micronize the particle diameter of the binder resin particulates to a desired particle diameter.

To suppress the problem described above, a basic substance may be added into the aqueous medium in the preparation method 1. Any basic substance may be added so long as it can address the problem described above. Examples of basic substances that can be used include: alkali metal hydroxides (sodium hydroxide, potassium hydroxide, and lithium hydroxide), alkali metal carbonates (sodium carbonate and potassium carbonate), alkali metal hydrogencarbonates (sodium hydrogencarbonate and potassium hydrogencarbonate), and nitrogen-containing basic organic compounds (N,N-dimethylethanolamine, N,N-diethylethanolamine, triethanolamine, tripropanolamine, tributanolamine, trimethylamine, n-propylamine, n-butylamine, isopropylamine, monomethanolamine, morpholine, methoxypropylamine, pyridine, and vinylpyridine).

Examples of surfactants that can be sued include: anionic surfactants, cationic surfactants, and nonionic surfactants. Examples of the anionic surfactants include: a sulfate ester salt type surfactant, a sulfonic acid salt type surfactant, a phosphate ester salt type surfactant, and soap. Examples of cationic surfactants that can be used include: an amine salt type surfactant and a quaternary ammonium salt type surfactant. Examples of nonionic surfactants that can be used include: a polyethylene glycol type surfactant, a alkylphenol ethylene oxide adduct surfactant, and a polyhydric alcohol type surfactant (a derivative of polyhydric alcohol such as glycerin, sorbitol, or sorbitan). Among the surfactants, the anionic surfactant is preferable. One type of the surfactants may be used alone, or two or more of them may be used in combination.

An amount of the surfactant is preferably at least 0.01 mass % and no greater than 10 mass % relative to the mass of the binder resin. With the amount of the surfactant in such a range, dispersibility of the binder resin particulates in the aqueous dispersion liquid can be improved.

Hereinafter, the preparation method 2 will be described. The releasing agent is pulverized in advance into an average particle diameter of no greater than 100 μm to obtain a powder of the releasing agent. The obtained powder of the releasing agent is added into an aqueous medium to prepare slurry. Note that the aqueous medium described above contains a surfactant in advance.

An amount of the surfactant is preferably at least 0.01 mass % and no greater than 10 mass % relative to the mass of the releasing agent. With the amount of the surfactant in such a range, dispersibility of the binder resin particulates in the aqueous dispersion liquid can be improved.

Next, the slurry is heated to temperature equal to or higher than a melting point of the releasing agent. Strong shear force is given to the heated slurry by using a homogenizer (for example, "ULTRA-TURRAX T501" produced by IKA Japan K.K.) or a disperser such as a pressure discharge type disperser to obtain an aqueous dispersion liquid (a dispersion liquid of releasing agent particulates) containing the releasing agent particulates. Examples of apparatuses that give strong shear force to the dispersion liquid include NANO3000 (produced by Beryu Corporation), Nanomizer (produced by YOSHIDA KIKAI CO., LTD.), Microfluidizer (registered Japanese trademark) (produced by Microfluidic Corporation), Gorlin homogenizer (produced by SPX Corporation), and CLEARMIX (registered Japanese trademark) W motion (produced by Mtechnique Co. Ltd.).

An average particle diameter of the releasing agent particulates contained in the dispersion liquid of the releasing agent particulates is preferably no greater than 1 μm, more preferably at least 0.1 μm and no greater than 0.7 μm, and even more preferably at least 0.28 μm and no greater than 0.55 μm. With the average particle diameter of the releasing agent particulates in such a range, the releasing agent is uniformly dispersed in the binder resin. Note that the average particle diameter of the releasing agent particulates can be measured in the same way as the average particle diameter of the binder resin particulates.

Hereinafter, the preparation method 3 will be described. In an aqueous medium containing a surfactant, a colorant and a component such as a colorant-containing dispersant when necessary are subjected to a dispersion treatment using a well-known disperser. As a result, an aqueous dispersion liquid containing colorant particulates (a dispersion liquid of colorant particulates) is prepared. As a surfactant that can be used as the dispersion liquid, the surfactant used for preparing the binder resin particulates described above can be used.

An amount of the surfactant is preferably at least 0.01 parts by mass and no greater than 10 parts by mass relative to 100 parts by mass of the colorant. With the amount of the surfactant in such a range, dispersibility of the colorant particulates in the aqueous dispersion liquid can be improved.

Examples of the disperser used for the dispersion treatment include: a pressure disperser and a medium disperser. Examples of the pressure disperser include: a mechanical homogenizer, Golin homogenizer, a pressure type homogenizer, and a high pressure type homogenizer (produced by YOSHIDA KIKAI CO., LTD.). Examples of the medium disperser include: a sand grinder, a horizontal or vertical bead mill, Ultra Apex Mill (produced by KOTOBUKI KOGYO CO., LTD.), DYNO-Mill (registered Japanese trademark) (produced by WAB Corporation), and MSC Mill (produced by NIPPON COKE & ENGINEERING CO., LTD.). Dispersers other than those described above include an ultrasonic disperser.

An average particle diameter of the colorant particulates is preferably at least 0.01 μm and no greater than 0.2 μm. With the average particle diameter of the colorant particulates in such a range, the colorant is uniformly dispersed in the binder resin. Note that the average particle diameter of the colorant particulates can be measured in the same manner as the average particle diameter of the binder resin particulates.

In order to contain a predetermined component in the toner core, both or either of the dispersion liquid of the releasing agent particulates and the dispersion liquid of the colorant particulates are appropriately combined and mixed with the prepared dispersion liquid of the binder resin particulates when necessary. Next, these particulates are aggregated in the mixed dispersion liquid to thereby obtain an aqueous dispersion liquid containing the aggregated particles including the binder resin.

As a method of aggregating the particulates in the aggregation process, there is a method described below. Specifically, the method includes adjusting pH of the aqueous dispersion liquid containing the binder resin particulates, adding a coagulant to the aqueous dispersion liquid, and then adjusting temperature of the aqueous dispersion liquid to predetermined temperature to aggregate the particulates.

Examples of the coagulant include: an inorganic metal salt, an inorganic ammonium salt, and a di- or higher-valent metal complex. Examples of inorganic metal salts include: metal salts (sodium sulfate, sodium chloride, calcium chloride, calcium nitrate, barium chloride, magnesium chloride, zinc chloride, aluminum chloride, and aluminum sulfate) and inorganic metal salt polymers (poly-aluminum chloride and poly-aluminum hydroxide). Examples of the inorganic ammonium salt include: ammonium sulfate, ammonium chloride, and ammonium nitrate. Moreover, a quaternary ammonium salt type cationic surfactant or a nitrogen-containing compound (for example, polyethylenimine) may be used as the coagulant.

As the coagulant, a di- or higher-valent metal salt or a monohydric metal salt can be used. One type of the above coagulants may be used alone, or two or more types of them may be used in combination. In a case where two or more types of coagulants are used, the divalent metal salt and the monovalent metal salt are preferably used in combination. This is because there is a difference in an aggregation rate between particulates of the divalent metal salt and particulates of the monovalent metal salt, and thus the combined use of the divalent metal salt and the monovalent metal salt can control an average particle diameter of obtained aggregated particles. Thus, particle size distribution of the aggregated particles can be sharpened. In the aggregation process, the pH of the aqueous dispersion liquid upon the addition of the coagulant is preferably adjusted to an alkaline of 8 or more. The coagulant may be added at a time or sequentially.

An additive amount of the coagulant is preferably at least 1 part by mass and no greater than 50 parts by mass relative to 100 parts by mass of a solid content of the aqueous dispersion liquid. With the additive amount of the coagulant in such a range, the aggregation of the particulates can favorably be promoted. The additive amount of the coagulant can appropriately be adjusted in accordance with a type and an amount of a dispersant contained in the dispersion liquid of particulates.

In the aggregation process, temperature of the aqueous dispersion liquid upon particulate aggregation is preferably in a temperature range of at least the glass transition point (Tg) of the binder resin and less than the glass transition point (Tg) of the binder resin plus 10° C. With the temperature of the aqueous dispersion liquid in such a range, aggregation of the particulates contained in the aqueous dispersion liquid can favorably be promoted.

After the aggregation is promoted to such an extent that the average particle diameter of the aggregated particles reaches a desired value, an aggregation terminating agent may be added. Examples of aggregation terminating agents that can be used include: sodium chloride, potassium chloride, and magnesium chloride. One type of the above aggregation terminating agents may be used alone, or two or more types of them may be used in combination.

[Coalescing Process]

Next, in the coalescing process, the component contained in the aggregated particles obtained through the aggregation process is caused to coalesce in the aqueous medium to form the toner cores. To cause the component contained in the aggregated particles to be coalesce, the aqueous dispersion liquid containing the aggregated particles obtained through the aggregation process may be heated. As a result, the aqueous dispersion liquid containing the toner cores can be obtained.

In the coalescing process, heating temperature of the aqueous dispersion liquid containing the aggregated particles is preferably in a temperature range of at least the glass transition point (Tg) of the binder resin plus 10° C. and no greater than the melting point of the binder resin. With the heating temperature of the aqueous dispersion liquid containing the aggregated particles in such a temperature range, coalescence of the component contained in the aggregated particles can favorably be promoted.

The aqueous dispersion liquid that contains the toner cores and that has already been subjected to the coalescing process may go through a cleaning process and a drying process when necessary.

In the cleaning process, the toner cores obtained by the aggregation method is cleaned with water. An example of the cleaning method is a method of collecting, from the dispersion liquid containing the toner cores, a wet cake containing the toner cores through solid-liquid separation and then cleaning the collected wet cake with water. An alternative example of the cleaning method is a method of sedimentation of the toner cores in the aqueous dispersion liquid containing the toner cores, replacing the supernatant with water, and dispersing the toner cores in the water again after the replacement.

In the drying process, the toner cores already subjected to the cleaning process are dried. Examples of a dryer used in the drying process include: a spray dryer, a fluidized bed dryer, a vacuum freeze dryer, and a reduced pressure dryer.

[Shell Layer Formation Process]

Shell layer formation process includes a supply process and a resinification process. In the supply process, a shell layer forming solution containing both or either of a monomer and a prepolymer of a thermosetting resin is supplied to the surfaces of the toner cores. The resinification process is a process of performing resinification by polymerizing or condensing both or either of the monomer and the prepolymer of the thermosetting resin contained in the shell layer forming solution.

Hereinafter, the supply process will be described. Examples of the method of supplying the shell layer forming solution to the toner core include: a method of spraying the shell layer forming solution to the surfaces of the toner cores and a method of immersing the toner cores in the shell layer forming solution.

To improve dispersibility of the toner cores in the shell layer forming solution, a dispersant may be added to the shell layer forming solution.

Examples of the dispersant include: sodium polyacrylate, polyparavinyl phenol, partially saponified polyvinyl acetate, isoprene sulfonate, polyether, a copolymer of isobutylene/maleic anhydride, sodium polyaspartate, starch, gum arabic, polyvinylpyrrolidone, and sodium ligninesulfonate. One type of the above dispersants may be used alone, or two or more of them may be used in combination.

To prepare the shell layer forming solution, for example, a solvent, both or either of a monomer and a prepolymer of a thermosetting resin, and, when necessary, any other additive (for example, a dispersant to be described later on) may be blended together through stirring. Examples of the solvent include: toluene, acetone, methyl ethyl ketone, tetrahydrofuran, methanol, ethanol, and water.

The shell layer forming solution may contain a well-known dispersant to improve dispersibility of both or either of the monomer and prepolymer of the thermosetting resin in the solvent. A content of the dispersant in the shell layer forming solution is preferably at least 0.1 parts by mass and no greater than 15 parts by mass relative to 100 parts by mass of the shell layer forming solution. With the content of the dispersant in the shell layer forming solution being at least 0.1 parts by mass relative to 100 parts by mass of the shell layer forming solution, the dispersibility of the toner particles can be made favorable. By contrast, with the content of the dispersant in the shell layer forming solution being no greater than 15 parts by mass relative to 100 parts by mass of the shell layer forming solution, environmental loads resulting from the amount of the dispersant can be reduced. Note that after production of the electrostatic charge image developing toner of the present embodiment, the dispersant remaining in the toner may be removed by cleaning treatment.

Hereinafter, the resinification process will be described. Through this process, the shell layer is formed on the surface of the toner core. Note that the resinification includes not only complete resignification with a sufficiently high polymerization degree of both or either of the monomer and prepolymer of the thermosetting resin but also partial resinification with a moderate polymerization degree of both or either of the monomer and prepolymer of the thermosetting resin.

Examples of the method of polymerizing the thermosetting resin in the resinification process include: an in-situ polymerization method, a solution hardening coating method, and a coacervation method. In terms of reactivity of the thermosetting resin, a uniformly covered shell layer can be obtained by the in-situ polymerization method. In the in-situ polymerization method, a resin material for shell layer formation is present only in the aqueous medium, and the material is reacted and resinified on the surfaces of the toner cores whereby the shell layer is formed.

Temperature in shell layer formation is preferably at least 60° C. and no greater than 70° C. Maintaining the temperature in shell layer formation at least 60° C. can provide sufficiently high hardness of the shell layer. By contrast, maintaining the temperature in the shell layer formation at no greater than 70° C. can suppress an excessive increase in the hardness of the shell layer and can easily destroy the shell layer through heating and pressurization upon toner fixation.

Moreover, a heating rate at which heating is performed up to the temperature in the shell layer formation is preferably at least 1° C./min and no greater than 3° C./min. With an excessively fast heating rate, polymerization or condensation of the thermosetting resin contained in the shell layer may start before the toner core is spheroidized by surface tension, resulting in difficulty in obtaining a spherical toner particle. With an excessively slow heating rate, the toner cores may be softened before polymerization or condensation of the thermosetting resin contained in the shell layers, leading to aggregation of the toner cores.

The method for producing the toner of the present embodiment may go through, when necessary, at least one process selected from the cleaning process, the drying process, and the external addition process after passage through the shell layer formation process.

In the cleaning process, the toner mother particles obtained by executing the shell layer formation process are cleaned with water. As an example of the cleaning process, there is a method including collecting, from a dispersion liquid containing toner mother particles, a wet cake containing the toner mother particles through solid-liquid separation and then cleaning the collected wet cake with water. As an alternative example of the cleaning method, there is a method including performing sedimentation of the toner mother particles in the aqueous dispersion liquid containing the toner mother particles, replacing a supernatant with water, and then dispersing the toner mother particles in the water again after the replacement.

As the drying process, for example, a dryer (for example, a spray dryer, a fluidized bed dryer, a vacuum freeze dryer, or a reduced pressure dryer) is used to dry the toner. Among the dryers, the spray dryer is preferably used since it is easy to inhibit aggregation of the toner particles (toner mother particles) during drying. In a case where the spray dryer is used, for example, a dispersion liquid with an external additive (for example, silica particulates) dispersed therein following drying can be sprayed, thus permitting simultaneous performance of the external addition process to be described below.

<External Addition Process>

An external additive is made adhere to the surfaces of the shell layers to thereby obtain toner particles. Hereinafter, an external addition method according to the present embodiment will be described.

As a preferable external addition method, for example, external addition condition is adjusted in a manner such that the external additive is not embedded in the shell layers, and the toner mother particles and the external additive are mixed together using a mixing machine (for example, an FM mixer or a Nauta mixer (registered Japanese trademark) to make the external additive adhere to the surfaces of the shell layers.

EXAMPLES

Hereinafter, with reference to examples, the present invention will be described in more detail. Note that the present invention is not at all limited to a range of the examples.

Example 1

<Toner Core Preparation Process>

A polyester resin A (Mn=2500, Mw=5000, Mw/Mn=2.0, Tm=85° C., and Tg=43° C.) was pulverized using a mechanical pulverizer ("Turbo Mill" produced by Freund- Turbo Corporation) into an average particle diameter of 30 μm to obtain a coarsely pulverized product. To prepare 1000 g of slurry overall, 200 g of the obtained coarsely pulverized product, 30 g of an 1N-sodium hydroxide aqueous solution, and 770 g of ion exchanged water were mixed together. Next, the obtained slurry was dropped into a condenser-fitted, round-bottom stainless container with a capacity of 2 L and stirred at a liquid temperature of 95° C. and a rotation speed of 200 rpm for 30 minutes. Then it was cooled to room temperature and subjected to solid-liquid separation using a 300-mesh filter to obtain a solid material. The obtained solid material was subjected to water cleaning and drying to obtain an alkali-treated product of the polyester resin A. As described above, the polyester resin A was subjected to the alkali-treatment to obtain 1000 g of the alkali-treated product of the polyester resin A overall.

The obtained 1000 g of the alkali-treated product of the polyester resin A was dropped into a kneading machine ("TK Hivis Disper Mix HM-3D-5 model" produced by PRIMIX Corporation) provided with a jacket and heated to 120° C. to be melted. To the obtained melt, 80 g of triethanolamine was added and 80 g of a lauryl sodium sulfate aqueous solution ("Emal 0" produced by KAO Corporation) with a concentration of 25 mass % was further added, and kneading was performed for 15 minutes under a condition of a planetary rotation speed of 50 rpm. Then 2870 g of ion exchanged water at 98° C. was added to the kneading machine at a supply speed of 50 g/min. Then it was cooled to 50° C. at a temperature decrease rate of 5° C./min. to obtain a dispersion liquid of binder resin particulates. The binder resin particulates in the dispersion liquid have a solid concentration of 25 mass % and a volume median diameter ($D_{50}$) of 115 nm.

Next, 200 g of a releasing agent ("WEP-3" with a melting point of 73° C., produced by NOF Corporation) and 20 g of lauryl sodium sulfate, and 780 g of ion exchanged water were blended, then heated to 90° C., and mixed for five minutes using a homogenizer ("ULTRA-TURRAX T50" produced by IKA Corporation). Further, heating and mixing were performed with a discharge pressure of 100 MPa and at 100° C. using a high-pressure homogenizer ("NV-200" produced by YOSHIDA KIKAI CO., LTD.) to obtain a dispersion liquid of releasing agent particulates. The releasing agent particulates in the dispersion liquid had a solid concentration of 10 mass % and a volume median diameter ($D_{50}$) of 120 nm.

Subsequently, 100 g of a colorant (C. I. PigmentBlue15:3), 20 g of a sodium polyxyethylene laurylether sulfate aqueous solution ("Emal E-27C" produced by KAO Corporation) with a concentration of 27 mass %, and 380 g of ion exchanged water were blended and subjected to a wet finely dispersing treatment using a bead mill ("DYNO-MILL" (registered Japanese trademark) produced by WAB Corporation) to obtain a dispersion liquid of colorant particulates. The colorant particulates in the dispersion liquid had a solid concentration of 20 mass %, a total solid concentration of 21 mass %, and a volume median diameter ($D_{50}$) of 113 nm.

[Aggregation Process]

Into a stainless round-bottom flask container with a capacity of 2 L, 340 g of the dispersion liquid of the binder resin particulates described above, 50 g of the dispersion liquid of the releasing agent particulates described above, 25 g of the dispersion liquid of the colorant particulates described above, and 500 g of ion exchanged water were dropped. The dispersion liquids were stirred at a rotation speed of 200 rpm using a stirring impeller. Then a sodium hydroxide aqueous solution was added, and pH was adjusted to 10. Then stirring was performed at 25° C. for ten minutes. Then 10 g of a magnesium chloride hexahydrate aqueous solution with a concentration of 50 mass % was dripped for five minutes. The obtained dispersion liquid was heated to 50° C. at a heating rate of 0.2° C./min, and then the particulates were aggregated while being stirred at this temperature for 30 minutes. To stop the aggregation of the particulates, 50 g of a sodium chloride aqueous solution with a concentration of 20 mass % was added at a time.

[Coalescing Process]

Next, 100 g of a lauryl sodium sulfate aqueous solution with a concentration of 5 mass % was added. The obtained dispersion liquid was increased to 65° C. at a heating rate of 0.2° C./min. and was stirred at this temperature for one hour. Then it was cooled to 25° C. at a temperature decrease rate of 10° C./min. to obtain toner cores. The toner cores had a volume median diameter ($D_{50}$) of 6.0 μm and a sphericity of 0.941.

<Shell Layer Formation Process>

A three-neck flask provided with a thermometer, a stirrer, and a cooler and having a capacity of 1 L was set in a water bath at 30° C. Into the flask, 300 mL of ion exchanged water was introduced, hydrochloric acid was further added, and pH was adjusted at 4.2 mL of a hexamethylol melamine precursor as a melamine resin precursor (an aqueous solution of a hexamethylol melamine prepolymer, "MIRBANE (registered Japanese trademark) RESIN SM-607" produced by Showa Denko K.K. with a solid concentration of 80 mass %) was added to the obtained acid aqueous solution, and mixing and dissolution were performed. To the obtained mixed solution, 300 g of the toner cores described above were added in a manner such that a film thickness of the shell layers becomes 6 nm, and stirring was performed. Further, 300 mL of ion exchanged water was added, heating to 60° C. was performed at a heating rate of 5° C./min. while being stirred, and then another stirring was performed at this temperature for two hours to form shell layers on surfaces of the toner cores.

Next, contents in the flask were cooled to 25° C. Then sodium hydroxide was added, and neutralization was performed. Then vacuum filtration was performed using a Buchner funnel to collect a wet cake containing toner mother particles. Further, the wet cake containing the toner mother particles and already subjected to the filtration was dispersed using ion exchanged water to clean the toner mother particles. Then the same cleaning of the toner mother particles with the ion exchanged water was repeated six times. The wet cake containing the toner mother particles and already subjected to the cleaning was dispersed in an ethanol aqueous solution with a concentration of 50 mass %, and was dried using a particulate surface modification apparatus ("Coatmizer (registered Japanese trademark)" produced by FREUND-TURBO CORPORATION) under condition at a hot air temperature of 45° C. and a blower wind volume of 2 $m^3$/min. Table 1 shows volume median diameters ($D_{50}$) and sphericity of the obtained toner particles.

Relative to 100 parts by mass of the obtained toner particles, 0.4 g of positively chargeable silica ("AEROSIL (registered Japanese trademark) 90G" produced by NIPPON AEROSIL CO., LTD.) with a primary average particle size of 20 nm was added, and a mixing treatment was performed for five minutes using FM mixer (produced by NIPPON COKE & ENGINEERING CO., LTD.) with a capacity of 5 L. Then the obtained toner particles were screened with a 300 mesh (with an opening of 48 μm) to obtain an electrostatic charge image developing toner of Example 1.

Example 2

With the polyester resin A replaced with polyester resin B (Mn=3200, Mw=6400, Mw/Mn=2.0, Tm=95° C., and Tg=48° C.) and the temperature in the shell layer formation changed from 60° C. to 70° C., the same operation as that of Example 1 was performed to obtain an electrostatic charge image developing toner of Example 2.

Example 3

With the polyester resin A replaced with polyester resin C (Mn=2800, Mw=5600, Mw/Mn=2.0, Tm=90° C., and Tg=45° C.) and the temperature in the shell layer formation changed from 60° C. to 65° C., the same operation as that of Example 1 was performed to obtain an electrostatic charge image developing toner of Example 3.

Example 4

With the temperature in the shell layer formation changed from 60° C. to 62° C., the same operation as that of Example 1 was performed to obtain an electrostatic charge image developing toner of Example 4.

Example 5

With the temperature in the shell layer formation changed from 60° C. to 64° C., the same operation as that of Example 1 was performed to obtain an electrostatic charge image developing toner of Example 5.

Example 6

With the temperature in the shell layer formation changed from 60° C. to 66° C., the same operation as that of Example 1 was performed to obtain an electrostatic charge image developing toner of Example 6.

Example 7

With the temperature in the shell layer formation changed from 60° C. to 68° C., the same operation as that of Example 1 was performed to obtain an electrostatic charge image developing toner of Example 7.

Example 8

Into a flask having a capacity of 2 L and provided with a stirrer, a thermometer, a condenser, and a nitrogen inlet tube, 250 g of isobutanol was dropped, while nitrogen is introduced, 155 g of styrene, 75 g of butyl acrylate, and 36 g of t-butyl peroxy 2-ethyl hexanoate (produced by Arkema Yoshitomi, Ltd.) were added. Then heating to 100° C. was performed, and stirring was performed at this temperature for three hours. Further, 12 g of t-butyl peroxy 2-ethyl hexanoate was added, and stirring was performed for three hours. Then reduced pressure drying was performed with 10 kPa and at 140° C. to evaporate isobutanol to obtain a dry product. The obtained dry product was broken up to obtain a pulverized product with an average particle diameter of no greater than 10 μm. 100 g of the obtained pulverized product, 1 g of an anionic surfactant ("Emal 0" produced by KAO Corporation), and 25 g of a 0.1N-sodium hydroxide aqueous solution were blended. Then ion exchanged water was added in a manner such that a total amount of the solution reaches 400 g to obtain a slurry. Next, the obtained slurry was dropped into a heat-resistant round-bottom stainless container, and the slurry in the container was subjected to shearing dispersion with 0.5 MPa, at 140° C., and at a rotor rotation speed of 20000 rpm for 30 minutes using a high-speed shearing emulsification apparatus ("CLEARMIX (registered Japanese trademark) CLM-2.2S"). Then while stirring is performed at a rotation speed of 15000 rpm, cooling to 50° C. was performed at a temperature decrease rate of 5° C./min. to obtain a dispersion liquid of particulates of the styrene-acrylic resin A. The styrene-acrylic resin A in the dispersion liquid had a volume median diameter ($D_{50}$) of 120 nm, a solid concentration of 29.8 mass %, Mn=7000, Mw=16000, Mw/Mn=2.29, Tm=90.0° C., and Tg=45.2° C.

With the polyester resin A replaced with styrene-acrylic resin A, the same operation as that of Example 1 was performed to obtain an electrostatic charge image developing toner of Example 8.

Comparative Example 1

With the polyester resin A replaced with a polyester resin D (Mn=2400, Mw=4800, Mw/Mn=2.0, Tm=83° C., and Tg=42° C.), the same operation as that of Example 1 was performed to obtain an electrostatic charge image developing toner of Comparative Example 1.

Comparative Example 2

With the polyester resin A replaced with a polyester resin E (Mn=3400, Mw=6800, Mw/Mn=2.0, Tm=97° C., and Tg=49° C.) and the temperature in the shell layer formation changed from 60° C. to 70° C., the same operation as that of Example 1 was performed to obtain an electrostatic charge image developing toner of Comparative Example 2.

Comparative Example 3

With the temperature in the shell layer formation changed from 60° C. to 59° C., the same operation as that of Example 1 was performed to obtain an electrostatic charge image developing toner of Comparative Example 3.

Comparative Example 4

Into a flask having a capacity of 2 L and provided with a stirrer, a thermometer, a condenser, and a nitrogen inlet tube, 240 g of n-propyl alcohol was dropped, and then 67.5 g of styrene and 22.5 g of butyl methacrylate were added while introducing nitrogen, and heating to 65° C. was performed. Further, a solution obtained by dissolving 1 g of a hydrocarbon diluted product of t-hexylperoxypivalate ("perhexyl PV" produced by NOF Corporation) in 40 g of n-propyl alcohol was dripped at 65° C. for three hours, and then stirring was performed for five hours. Further, heating to 80° C. was performed and stirring was performed at 80° C. for one hour. Then reduced pressure drying was performed with 10 kPa and at 140° C. for evaporation of n-propyl alcohol to obtain a dry product. The obtained dry product was broken up to obtain a pulverized product with an average particle diameter of 10 μm or less. 100 g of the obtained pulverized product, 1 g of cationic surfactant ("QUARTAMIN 24P" produced by KAO Corporation), and 25 g of a 0.1N-sodium hydroxide aqueous solution were blended. Then ion exchanged water was added in a manner such that a total amount of the solution reaches 400 g to obtain a slurry. Next, the obtained slurry was dropped into a heat-resistant round-bottom stainless container, and the slurry in the container was subjected to shearing dispersion with 0.5 MPa, at 140° C., and at a rotor rotation speed of 20000 rpm for 30 minutes using a high-speed shearing emulsification apparatus (CLEARMIX (registered Japanese trademark) "CLM-2.2S" produced by Mtechnique Co., Ltd.). Then while performing stirring at a rotation speed of 15000 rpm, and cooling to 50° C. was performed at a temperature decrease rate of 5° C./min. to obtain a dispersion liquid of particulates of styrene-acrylic resin B. The styrene-acrylic resin B in the dispersion liquid had a volume median diameter ($D_{50}$) of 130 nm, a solid concentration of 20.3 mass %, Mn=50000, Mw=100000, Mw/Mn=2.0, Tm=150° C., and Tg=73° C.

With addition of 2 mL of the hexamethylolmelamine precursor used upon the shell layer formation being replaced with addition of 190 g of styrene-acrylic resin B, the same operation as that of Example 1 was performed to obtain an electrostatic charge image developing toner of Comparative Example 4.

<Measurement Methods and Evaluation Methods>

The measurement methods and the evaluation methods for the electrostatic charge image developing toners of Examples 1 to 8 and Comparative Examples 1 to 4 will be described below.

<Method of Measuring Content Ratio of Toner Component Insoluble in THF>

Into 200 mL of tetrahydrofuran (THF), 1.0 g ($W_1$) of each of the electrostatic charge image developing toners of Examples 1 to 8 and Comparative Examples 1 to 4 was added. Slurry obtained through this process was stirred for 12 hours to dissolve a resin ($W_2$) soluble in THF. Then the slurry was dropped into a soxhlet extractor provided with extraction thimble ("No. 86W" produced by Advantech Japan, Co., Ltd.) to extract resin dissolved in the THF for six hours. The extracted resin soluble in the THF was evaporated and then subjected to reduced pressure drying at 100° C. for one hour to obtain a resin soluble in THF. Using formula below, a content ratio of the toner component insoluble in the THF was calculated. Mass of the toner was defined as $W_1$ and mass of the resin soluble in the THF was defined as $W_2$ Content ratio of the toner component insoluble in the THF (mass %)=$(W_1-W_2)/W_1\times100$. Table 1 shows results of measuring the content ratios of toner component insoluble in the THF.

<Method of Measuring Melt Viscosity of Toner>

In an approximately 1.9 $cm^3$-cylindrical pellet, 1.4 g of each of the electrostatic charge image developing toners of Examples 1 to 8 and Comparative Examples 1 to 4 was molded. The obtained pellet was set in a flow tester (produced by Shimadzu Corporation). While performing heating at a heating rate of 2° C./min from 35° C. to 200° C., a load of 30 $kg/cm^2$ was applied by a plunger to push the pellet-shaped toner out of a nozzle. The melt viscosity of the toner at 75° C. was then measured. A die of 1.0 mm in height and 1.0 mm in diameter was used. Table 1 shows measured results of the melt viscosity of the toners at 75° C.

<Method of Measuring Particle Diameter of Toner>

The volume median diameters ($D_{50}$) of the toners obtained in Examples 1 to 8 and Comparative Examples 1 to 4 were measured using a particle size distribution analyzer ("Multisizer 3" produced by BECKMAN COULTER Co. Ltd.). Table 1 shows measured results of the volume median diameters ($D_{50}$) of the toner.

<Method of Measuring Sphericity of Toner>

The sphericity of the toners obtained in Examples 1 to 8 and Comparative Examples 1 to 4 was measured using a wet-flow type particle size/diameter analyzer ("FPIA (registered Japanese trademark)-3000" produced by Sysmex Corporation). Table 1 shows measured results of the sphericity of the toners.

<Method of Measuring Film Thickness of Shell Layer>

After sufficiently dispersing dry silica and each of the shelled toners in a cold-setting epoxy resin, they were hardened in an atmosphere of 40° C. for two days. The obtained hardened material was stained with osmium tetroxide, and then a thin sample was cut out using a microtome with a diamond knife set thereon, a cross-sectional form of the toner was observed using a transmission electron microscope (TEM), and a film thickness of the shell layer was measured. Table 1 shows measured results of the film thickness of the shell layer.

<Method of Measuring DSC Heat Absorption Peak of Toner>

The heat absorption peak of each of the toners obtained in Examples 1 to 8 and Comparative Examples 1 to 4 was measured using a differential scanning calorimeter ("DSC-6220" produced by Seiko Instruments Co. Ltd.). A heat absorption peak in a temperature range from 60° C. to 80° C. was obtained based on a heat quantity difference between the measured sample and a reference substance. It was assumed that when the heat absorption peak of each of the toners obtained in Examples 1 to 8 and Comparative Examples 1 to 4 is constant, a content of the releasing agent contained in the toner is constant. Table 1 shows measured results of the DSC heat absorption peaks of the toners.

(Preparation of Two-Component Developer for Evaluation)

Ion exchanged water was added to a powder obtained through blending to achieve 39.7 mol % by MnO conversion, 9.9 mol % by MgO conversion, 49.6 mol % by $Fe_2O_3$ conversion, and 0.8 mol % by SrO conversion, and pulverization and mixing were performed using a wet ball mill for 10 hours, and drying was performed. Then holding was performed at 950° C. for four hours. Then pulverization was performed using a wet ball mill for 24 hours to obtain a pulverized product. The obtained pulverized product was subjected to granulating and drying and held at 1270° C. in an atmosphere of an oxygen concentration of 2 vol % for six hours. Then breaking up and particle size adjustment were performed to obtain manganese-based ferrite particles. The average particle diameter of the manganese-based ferrite particles was 35 μm, and saturation magnetization where an applied magnetic field was 3000 ($1000/4\pi\cdot A/m$) was $70A\cdot m^2/kg$.

Next, a polyamide-imide resin as a copolymer of trimellitic anhydride and 4,4'-Diaminodiphenylmethane was diluted with methyl ethyl ketone to prepare a resin solution. Next, a copolymer (FEP) of tetrafluoroethylen and hexafluoropropylen were dispersed, and 2 mass % of silicon oxide relative to a total amount of the resins was further dispersed to obtain 150 g of a carrier-coating liquid by solid content conversion. It was assumed that a weight composition ratio between the polyamide-imide resin and the FEP was 2:8 and the solid concentration in the carrier-coating liquid was 10 mass %. Next, 10 kg of the manganese-based ferrite particles were coated with the carrier-coating liquid using a fluid bed coating apparatus ("SPIRA COTA SP-25" produced by OKADA SEIKO CO., LTD). Then baking was performed at 220° C. for one hour to obtain a resin-coating manganese-based ferrite carrier with a resin coating ratio of 3 mass %.

(Method of Measuring Minimum Fixable Temperature)

A two-component developer was filled in a black image developing device for a color printer ("TASKalfa5550ci"

produced by KYOCERA Document Solutions Inc.). Then each of the toners obtained in Examples 1 to 8 and Comparative Examples 1 to 4 were filled in a black toner container. A toner image (patch sample) dimensioned 2 cm×3 cm was outputted as a non-fixed image to an evaluation sheet ("Color Copy (registered Japanese trademark) 90" produced by MONDI Corporation) in a manner such that a toner load reaches 1.67 mg/cm$^2$. Next, in an environment of 25° C. and 50% RH, the non-fixed mage as the patch image was fixed using a fixing jig on 60 evaluation sheets at a linear velocity of 300 mm/sec. every 5° C. in a fixing temperature range of at least 80° C. and no greater than 200° C. Note that the fixing jig is a jig remodeled in a manner such that fixing temperature and a linear velocity of the fixing device of the color printer ("TASKalfa5550ci" produced by KYOCERA Document Solutions Japan Inc.) are variable. A surface material of a heating roll was PFA, the film thickness of the heating roll was 30 μm±10 μm, and the surface roughness (Ra) thereof was 5 μm. Next, visually observing the evaluation sheets on which the image has been fixed through fixation, a minimum fixable temperature was measured. With a minimum toner fixable temperature of over 100° C., the toner fixability was insufficient. With a minimum toner fixable temperature of no greater than 100° C., the toner fixability was favorable. Table 1 shows measured results of the minimum toner fixable temperature.

a mesh opening of 45 μm placed at a bottom, a screen with a mesh opening of 63 μm and the screen with a mesh opening of 105 μm were superposed thereon in order just mentioned. Next, the superposed screens were attached to a powder tester ("TYPE PT-E" produced by Hosokawa Micron Corporation). Then under condition with a memory of a powder tester set at 5, the toner was screened for 30 seconds. Next, the weight of the toner remaining on the screen was measured, and a degree of aggregation of the toner was obtained by a formula below.

Degree of aggregation (mass %)=(*a*)+(*b*)+(*c*).

(a) (Weight of the toner remaining on the screen with a mesh opening of 105 μm)/3×100

(b) (Weight of the toner remaining on the screen with a mesh opening of 63 μm)/3×3/5×100

(c) (Weight of the toner remaining on the screen with a mesh opening of 45 μm)/3×1/5×100

With the degree of toner aggregation being at least 15 mass %, the blocking resistance of the toner was insufficient. With the degree of toner aggregation being less than 15 mass %, the blocking resistance of the toner was favorable. Table 1 shows measured results of the degrees of toner aggregation.

Table 1 shows the results of the measurements and evaluation of the toners obtained in Examples 1 to 8 and Comparative Examples 1 to 4.

TABLE 1

| | Toner | | | | | | | |
|---|---|---|---|---|---|---|---|---|
| | Heat absorption peak (at least 60° C. and no greater than 80° C.) [J/g] | Toner component insoluble in THF [Mass %] | Melt viscosity at 75° C. [Pa · s] | Volume median diameter [μm] | Sphericity | Film thickness of shell layer [nm] | Low-temperature fixability Minimum fixable temperature [° C.] | Toner blocking resistance Degree of aggregation (60° C., 3 hours) [Mass %] |
| Example 1 | −5.733 | 90 | 10000 | 6.0 | 0.965 | 6 | 80 | 7 |
| Example 2 | −5.725 | 100 | 100000 | 6.0 | 0.960 | 6 | 100 | 3 |
| Example 3 | −5.742 | 95 | 50000 | 6.0 | 0.959 | 6 | 90 | 5 |
| Example 4 | −5.730 | 92 | 10000 | 6.0 | 0.952 | 6 | 80 | 7 |
| Example 5 | −5.728 | 94 | 10000 | 6.0 | 0.954 | 6 | 80 | 6 |
| Example 6 | −5.727 | 96 | 10000 | 6.0 | 0.957 | 6 | 85 | 4 |
| Example 7 | −5.726 | 98 | 10000 | 6.0 | 0.959 | 6 | 85 | 3 |
| Example 8 | −5.743 | 90 | 11000 | 6.0 | 0.958 | 6 | 80 | 5 |
| Comparative Example 1 | −5.762 | 90 | 9500 | 6.1 | 0.962 | 6 | 80 | 30 |
| Comparative Example 2 | −5.768 | 100 | 100500 | 6.0 | 0.957 | 6 | 105 | 4 |
| Comparative Example 3 | −5.774 | 83 | 10000 | 6.0 | 0.954 | 6 | 80 | 35 |
| Comparative Example 4 | −5.780 | 5 | 50000 | 6.1 | 0.962 | 130 | 90 | 47 |

(Method of Evaluating Blocking Resistance of Toner)

In a plastic container with a capacity of 20 mL, 3 g of each of the toners obtained in Examples 1 to 8 and Comparative Example 1 to 4 was dropped. The plastic container into which the toner was dropped was subjected to two-stage heating for three hours and 48 hours at 60° C. using a constant temperature bath ("CONVECTIONOVEN" produced by SANYO Electric Co., Ltd.). Then it was placed still in ban environment of 25° C. and 65% RH for 30 minutes. The toner in the plastic container taken out from the constant temperature bath was dropped into a screen with a known mass and a mesh opening of 105 μm and the mass of the screen before screening was measured to measure the weight of the toner on the screen. Next, with a screen with As is clear from Table 1, the electrostatic charge image developing toners obtained in Examples 1 to 8 were excellent in both the toner blocking resistance and the low-temperature fixability.

In the electrostatic charge image developing toner obtained in Comparative Example 1, the melt viscosity of the toner at 75° C. was as low as 9500 Pa·s, which was not within a range of at least 1.0×10$^4$ Pa·s and no greater than 1.0×10$^5$ Pa·s. Thus, the degree of toner aggregation was high and the toner blocking resistance was insufficient.

In the electrostatic charge image developing toner obtained in Comparative Example 2, the melt viscosity of the toner at 75° C. was larger than 1.0×10$^5$ Pa. Thus, the minimum toner fixable temperature was high and the toner low-temperature fixability was insufficient.

In the electrostatic charge image developing toner obtained in Comparative Example 3, the temperature in the shell layer formation was as low as 59° C. Thus, a degree of cross linking of the thermosetting resin contained in the shell layer was low, and it is thought that the content ratio of the toner component insoluble in the THF was less than 90 mass %. Thus, the degree of toner aggregation was high, and the toner blocking resistance was insufficient.

In the electrostatic charge image developing toner obtained in Comparative Example 4, the thermosetting resin was used for the shell layers, and thus the toner blocking resistance was insufficient.

INDUSTRIAL APPLICABILITY

The electrostatic charge image developing toners of the present embodiments can be favorably used in the image forming apparatus.

The invention claimed is:

1. An electrostatic charge image developing toner comprising a plurality of toner particles, wherein each of the plurality of toner particles includes a toner core and a shell layer covering the toner core, the toner core contains a polyester resin, the polyester resin having a softening point (Tm) of at least 85° C. and no greater than 95° C., the shell layer contains a melamine resin, a content ratio of a toner component insoluble in tetrahydrofuran is at least 90 mass % relative to mass of the toner, melt viscosity of the toner at 75° C. is at least $1.0\times10^4$ Pa·s and no greater than $1.0\times10^5$ Pa·s, and the content ratio of the toner component insoluble in tetrahydrofuran is at least 96 mass % and no greater than 100 mass % relative to the mass of the toner.

2. The electrostatic charge image developing toner according to claim 1, wherein the toner core does not contain an oil-soluble fluorescent dye.

3. The electrostatic charge image developing toner according to claim 1, wherein the polyester resin has a softening point (Tm) of at least 90° C. and no greater than 95° C.

4. The electrostatic charge image developing toner according to claim 1, wherein the content ratio of the toner component insoluble in tetrahydrofuran is 96 mass %, 98 mass %, or 100 mass % relative to the mass of the toner.

5. The electrostatic charge image developing toner according to claim 1, wherein the content ratio of the toner component insoluble in tetrahydrofuran is 100 mass % relative to the mass of the toner.

* * * * *